US006871791B1

(12) United States Patent
Egan, Jr.

(10) Patent No.: US 6,871,791 B1
(45) Date of Patent: Mar. 29, 2005

(54) CONCRETE RAILROAD GRADE CROSSING PANELS

(76) Inventor: Thomas L. Egan, Jr., 9110 Davenport St., Omaha, NE (US) 68114

( * ) Notice: Subject to any disclaimer, the term of this patent is extended or adjusted under 35 U.S.C. 154(b) by 0 days.

(21) Appl. No.: 10/722,653

(22) Filed: Nov. 26, 2003

(51) Int. Cl.[7] ..... E01C 9/00
(52) U.S. Cl. ..... 238/8
(58) Field of Search ..... 238/1, 2, 3, 5, 238/7, 382

(56) References Cited

U.S. PATENT DOCUMENTS

| | | | | | |
|---|---|---|---|---|---|
| 1,694,557 | A | | 12/1928 | Oettinger | 238/9 |
| 2,789,771 | A | | 4/1957 | Bishop | 238/9 |
| 2,950,057 | A | * | 8/1960 | Speer | 238/8 |
| 3,056,555 | A | | 10/1962 | Eisses | 238/8 |
| 3,066,869 | A | | 12/1962 | Bishop | 238/9 |
| 3,469,783 | A | | 9/1969 | Uralli et al. | 238/8 |
| 3,825,184 | A | | 7/1974 | Hartl | 238/8 |
| 3,863,840 | A | | 2/1975 | Szarka et al. | 238/8 |
| 3,892,356 | A | | 7/1975 | Harmon | 238/8 |
| 3,955,761 | A | | 5/1976 | Szarka et al. | 238/8 |
| 4,093,120 | A | | 6/1978 | Canfield | 238/8 |
| 4,147,304 | A | | 4/1979 | Blyton | 238/8 |
| 4,236,670 | A | | 12/1980 | Limmergard et al. | 238/8 |
| 4,253,605 | A | | 3/1981 | Sims | 238/8 |
| 4,267,969 | A | | 5/1981 | Hales et al. | 238/8 |
| 4,365,743 | A | | 12/1982 | Trickel et al. | 238/8 |
| 4,368,845 | A | | 1/1983 | Perry et al. | 238/8 |
| 4,415,120 | A | * | 11/1983 | Thim | 238/8 |
| 4,449,666 | A | | 5/1984 | Hales et al. | 238/84 |
| 4,457,468 | A | | 7/1984 | Hales et al. | 238/8 |
| 4,461,421 | A | | 7/1984 | Maass | 238/8 |
| 4,641,779 | A | | 2/1987 | O'Brien et al. | 238/7 |
| 4,691,863 | A | | 9/1987 | Smith | 238/8 |
| 4,793,545 | A | | 12/1988 | Raymond | 238/8 |
| 4,823,452 | A | | 4/1989 | Cloutier | 29/235 |
| D301,435 | S | | 6/1989 | Martin | D12/49 |
| 4,860,952 | A | | 8/1989 | Schmidt | 238/8 |
| 4,899,932 | A | | 2/1990 | Beachy et al. | 238/8 |
| 4,899,933 | A | | 2/1990 | Martin | 238/8 |
| 4,911,360 | A | | 3/1990 | Spurr | 238/5 |
| 5,035,533 | A | | 7/1991 | Brown | 404/64 |
| 5,096,117 | A | | 3/1992 | Owen | 238/8 |
| 5,181,657 | A | | 1/1993 | Davis | 238/8 |
| 5,464,152 | A | | 11/1995 | Wabnitz | 238/8 |
| 5,535,947 | A | | 7/1996 | Hogue et al. | 238/2 |
| 5,535,948 | A | | 7/1996 | Williams | 238/8 |
| 5,538,182 | A | | 7/1996 | Davis et al. | 238/8 |
| 5,609,294 | A | | 3/1997 | Lucas, Jr. | 238/9 |
| 5,626,289 | A | | 5/1997 | Demers, Jr. et al. | 238/8 |
| 5,655,711 | A | | 8/1997 | Hull et al. | 238/8 |
| 5,740,961 | A | | 4/1998 | Bruning | 238/8 |
| 5,813,602 | A | * | 9/1998 | Holland | 238/8 |
| 5,850,970 | A | | 12/1998 | Hull et al. | 238/8 |
| 5,899,379 | A | | 5/1999 | Bruyn et al. | 238/8 |
| 6,068,195 | A | | 5/2000 | Gaudet | 238/8 |
| 6,079,630 | A | * | 6/2000 | Schroeder | 238/8 |
| 6,129,288 | A | * | 10/2000 | Petersen et al. | 238/8 |
| 6,427,925 | B1 | * | 8/2002 | Gaudet | 238/8 |
| 6,431,462 | B1 | * | 8/2002 | Apostolou et al. | 238/8 |
| 6,439,470 | B1 | * | 8/2002 | Hull | 238/8 |
| 6,588,676 | B1 | | 7/2003 | Birt et al. | 238/8 |

FOREIGN PATENT DOCUMENTS

| | | |
|---|---|---|
| DE | 1012628 | 7/1957 |
| DE | 2350759 A1 | 6/1975 |
| JP | 2887720 | 5/1994 |
| RU | 2001985 C1 | 10/1993 |

* cited by examiner

*Primary Examiner*—Mark T. Le

(57) ABSTRACT

A concrete railroad grade crossing comprised of a precast concrete gauge panel extending between the rails and precast concrete field panels which extend between each rail and the roadway. Elastomeric gauge seals are provided on the opposite sides of the gauge panels for sealing the space between the sides of the gauge panels and the rails. Elastomeric field seals are provided on the inner ends of the field panels for engagement with the outer sides of the rails. The seals are secured to the panels by bolt and channel member assemblies.

24 Claims, 5 Drawing Sheets

CONCRETE RAILROAD GRADE CROSSING PANELS

BACKGROUND OF THE INVENTION

1. Field of the Invention

This invention relates to an improved concrete railroad grade crossing, and more particularly to an improved railroad grade crossing comprising concrete gauge panels which extend between the rails and further comprising concrete field panels which extend between each rail and the roadway. Even more particularly, the invention relates to improved elastomeric gauge seals which are attached to the sides of the gauge panels and relates to improved elastomeric field seals which are attached to the inner ends of the field panels. More particularly, the invention relates to the means for securing the seals to the panels through the use of bolts which extend through the metal edge protector of the panel and into the side of the seal for connection to an elongated member channel positioned in an elongated channel-shaped cavity in the seal.

2. Description of the Prior Art

Frequently, a railroad track crosses a roadway which necessitates that the space between the rails be filled with a material which brings that space up to grade. It is also necessary to bring the approaches on either side of the rails up to grade. In the past, precast concrete panels, or gauge panels, have been positioned between the rails and precast concrete panels, or field panels, have been positioned on the approach sides of the track. The prior art railroad grade crossings have also used elastomeric seals on the sides of the concrete gauge panels to fill the space between the gauge panels and the rails to prevent foreign materials from entering and filling the space between the gauge panels and the rail. The prior art railroad grade crossings have also used elastomeric seals on the inner ends of the concrete field panels to prevent foreign materials from entering and filling the space between the field panel and the associated rail. In some cases, the upper inner ends of the field panels and the upper outer ends of the gauge panels were chamfered or beveled to prevent portions of the concrete field panels and gauge panels from chipping off and filling the spaces between the panels and the rails. In other cases, angle irons or edge protectors have been used as edge protectors to prevent the chipping problem.

In later years, the gauge seals and field seals have been partially embedded in the concrete panels to aid in attaching the seals to the panels. However, even where the seals are partially embedded in the prior art concrete panels, it is believed that the prior art devices experience some attachment problems of the seals. Assignee's co-pending application, Ser. No. 10/268,398 filed Oct. 10, 2002, is believed to solve at least some of the attachment problems. The instant invention is believed to represent a further advance in the art.

SUMMARY OF THE INVENTION

A railroad grade crossing for extending a roadway across a pair of parallel spaced-apart rails is disclosed. The railroad grade crossing includes one or more concrete gauge panels which extend substantially between the rails. Each of the gauge panels has a top surface which is substantially coplanar with the roadway with the bottom surface of the gauge panel being supported upon the ties. Each of the gauge panels has an elongated elastomeric gauge seal on each side thereof which is positioned adjacent the rails. The upper ends of the gauge seals are positioned downwardly from the top surface of the gauge panel with the upper ends of the gauge seals having arcuate recessed portions formed therein adjacent the outer ends thereof. The inner ends of the gauge seals are attached to the gauge panels by a bolt and channel member assembly. Concrete field panels are positioned between each rail and the roadway associated therewith. Each of the concrete field panels has a top surface which is substantially coplanar with the roadway and a bottom surface which is supported upon the ties. The field panels have elastomeric field seals at their inner ends thereof with the upper ends of the field seals being preferably positioned downwardly from the top surface of the field panels. The inner ends of the field seals are attached to the inner ends of the field panels by a bolt and channel member assembly.

Elongated, metal angle members (edge protectors) are cast in the upper outer edges of the gauge panels and the upper inner edges of the field panels and are maintained therein by horizontally disposed DBAs (deformed bar anchors) and by vertically disposed headed studs. The bolt and channel member assembly which connects the seals to the panels comprises a plurality of horizontally spaced-apart bolts extending outwardly through slots formed in the vertical legs of the edge protectors with the heads of the bolts being positioned at the inner surface of the vertical legs. The bolts extend through openings formed in the inner sides of the seals with the openings communicating with an elongated channel-shaped cavity formed in the seal. One or more channel members are positioned in the channel-shaped cavity and have nuts welded thereto which are positioned thereon in register with openings formed in the web of the channel member. The threaded inner ends of the bolts extend through the openings formed in the web of the channel member and are threadably attached to the nuts on the channel member to secure the seal to the panel.

It is therefore a principal object of the invention to provide an improved concrete railroad grade crossing.

A further object of the invention is to provide an improved concrete railroad grade crossing comprising concrete gauge panels and concrete field panels wherein elastomeric seals are bolted to the panels and extend therefrom so as to be positioned adjacent the rails.

Still another object of the invention is to provide an improved method of attaching elastomeric gauge and field seals to gauge panels and approach panels, respectively.

Still another object of the invention is to provide an improved railroad crossing which has greater durability than the railroad grade crossings of the prior art.

These and other objects will be apparent to those skilled in the art.

DESCRIPTION OF THE PREFERRED EMBODIMENT

Figure 1:
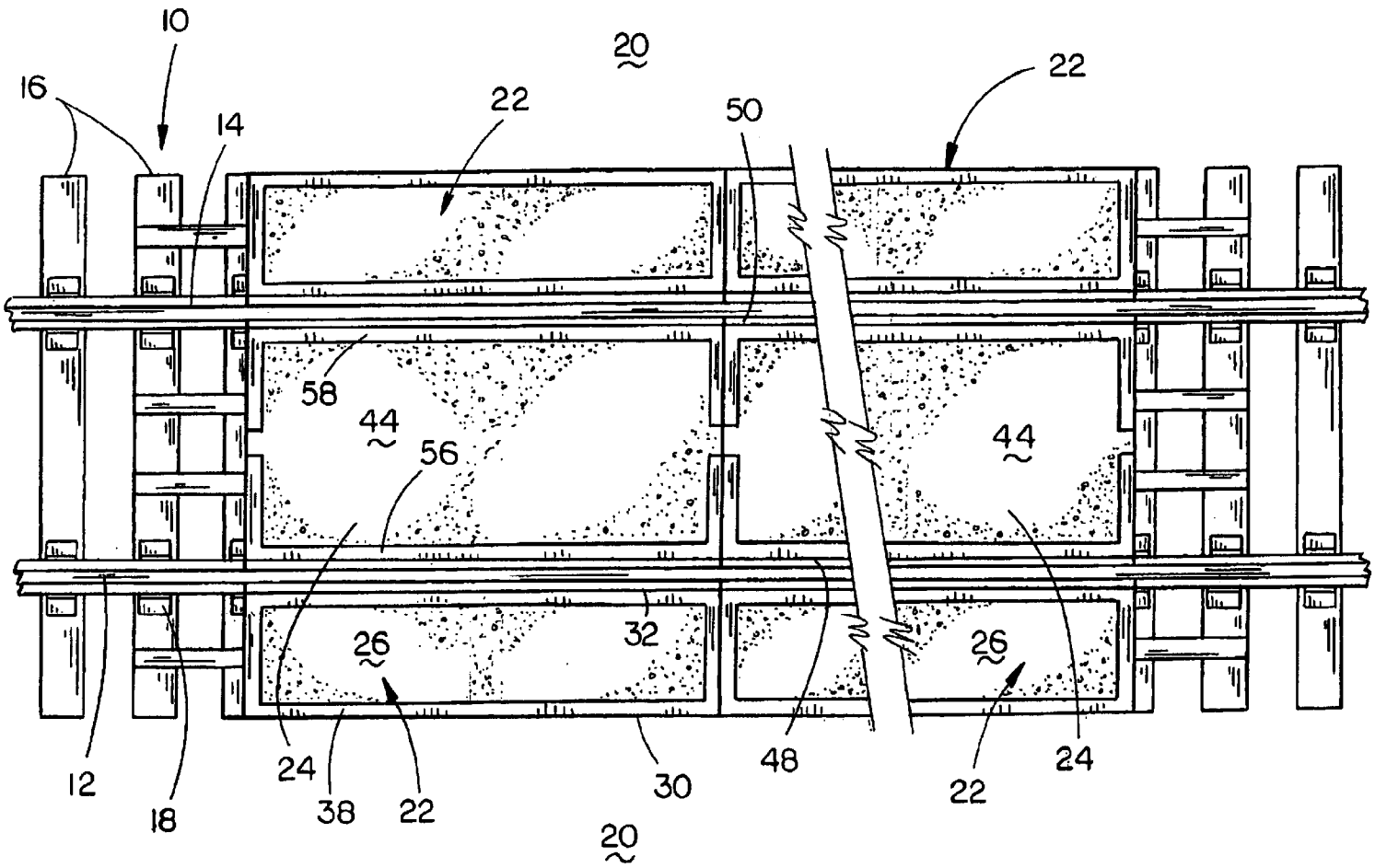
FIG. 1 is a partial top plan view of the concrete railroad grade crossing of this invention.

In the drawings, the numeral 10 refers to a railroad track including rails 12 and 14 which are supported upon a plurality of spaced-apart ties 16 by means of tie plates 18 which are secured to the ties 16 in conventional fashion such as by spikes, clips or bolts. In many cases, the railroad track 10 must cross a roadway which is generally referred to by the reference numeral 20.

Normally, a plurality of precast concrete approach or field panels 22 will be positioned between the roadway 20 and the rails 12 and 14 with the field panels 22 being supported upon the outer ends of the ties 16. Normally, the field panels 22 will be positioned between the roadway 20 and one of the rails in an end-to-end fashion, the number of which will depend upon the width of the roadway and the length of the field panels. The numeral 24 refers to precast concrete gauge panels which are positioned between the rails 12 and 14 and which are supported upon the ties 16. The gauge panels 24 are supported upon the ties 16 in an end-to-end fashion, the number of which will depend upon the width of the roadway and the length of the gauge panels.

Each of the approach or field panels 22 is comprised of a precast concrete material and includes top surface 26, bottom surface 28, and opposite sides 30 and 32. Field panel 22 is provided with a recessed portion 34 formed therein at each of the opposite sides thereof to provide a clearance space for the spikes, bolts, clips, etc., which secure the tie plates 18 to the ties 16 and which secure the rail to the tie plate 18 in conventional fashion.

An elongated, metal angle member 38 (edge protector) is cast in the field panel 22 at the upper inner side thereof, as illustrated in the drawings, and which is held in place in the concrete by horizontally disposed and horizontally spaced retainers, rods or bars 40 secured thereto which are commonly referred to as DBAs (deformed bar anchors). The angle member 38 is also held in place by a plurality of vertically disposed and horizontally spaced retainers or studs 41 secured thereto having enlarged head portions at their lower ends. As will be explained in more detail hereinafter, a field seal 42 is secured to the inner end of each of the field panels 22.

Figure 2:
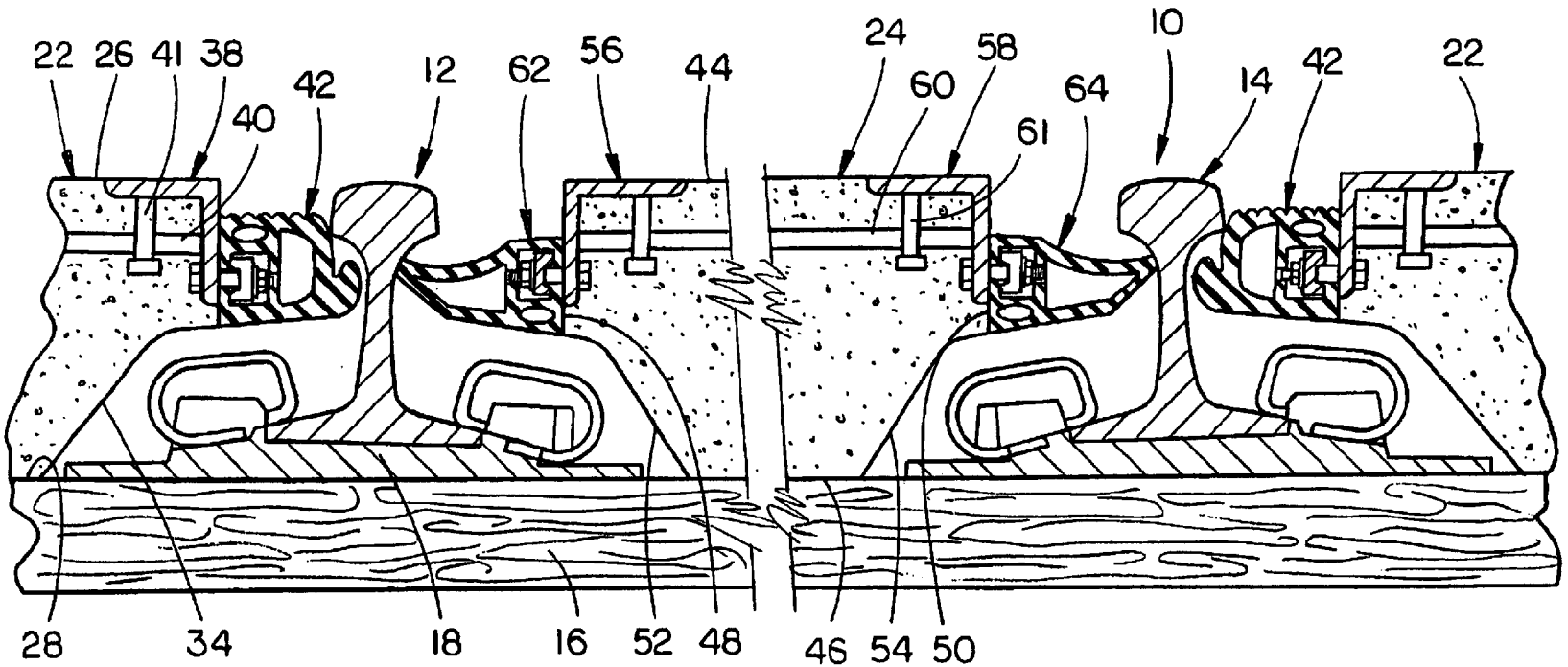
FIG. 2 is a partial vertical sectional view of the concrete railroad grade crossing of this invention.

Each of the gauge panels 24 is comprised of a precast concrete material and includes top surface 44, bottom surface 46, and opposite sides 48 and 50. Gauge panel 24 is provided with a recessed portion 52 at side 48 and is provided with a recessed portion 54 at its side 50, as seen in FIG. 2, to provide a clearance space for the spikes, bolts, clips, etc., which secure the tie plates 18 to the ties 16 and which secure the rails to the tie plates 18 in conventional fashion.

Elongated, metal angle members (edge protectors) 56 and 58 are cast in the gauge panel 24 at the upper outer sides thereof, as illustrated in the drawings, and which are held in place by horizontally disposed and horizontally spaced retainers, rods or bars 60 (DBAs) secured thereto. The angle members 56 and 58 are also held in place by a plurality of vertically disposed and horizontally spaced retainers or studs 61 secured thereto having enlarged head portions at their lower ends. As will be explained in more detail hereinafter, gauge seals 62 and 64 are secured to the outer sides of each of the gauge panels 24. Inasmuch as gauge seals 62 and 64 are identical, only gauge seal 62 will be described in detail.

Figure 3:
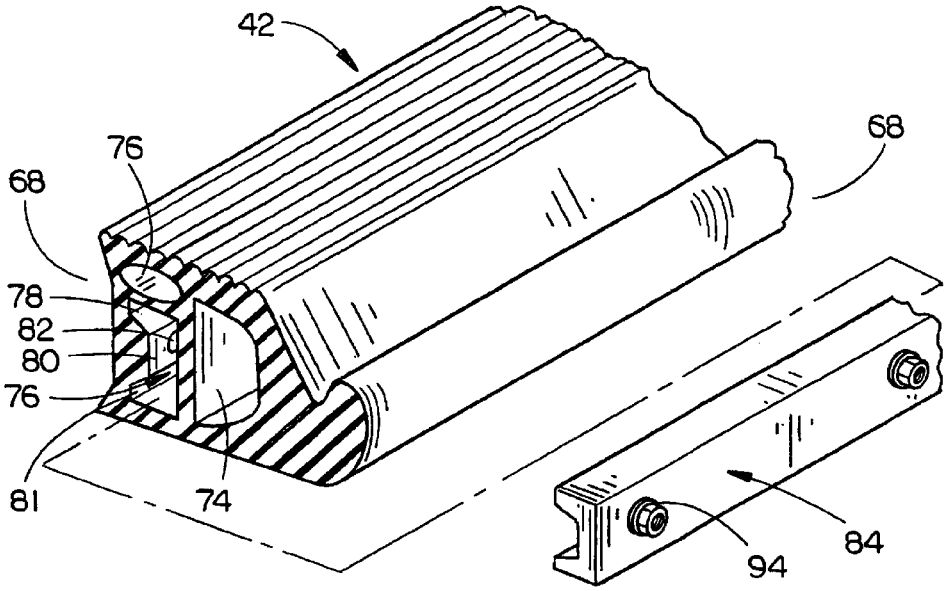
FIG. 3 is a partial exploded perspective view of one of the field panel seals of this invention.
Figure 4:
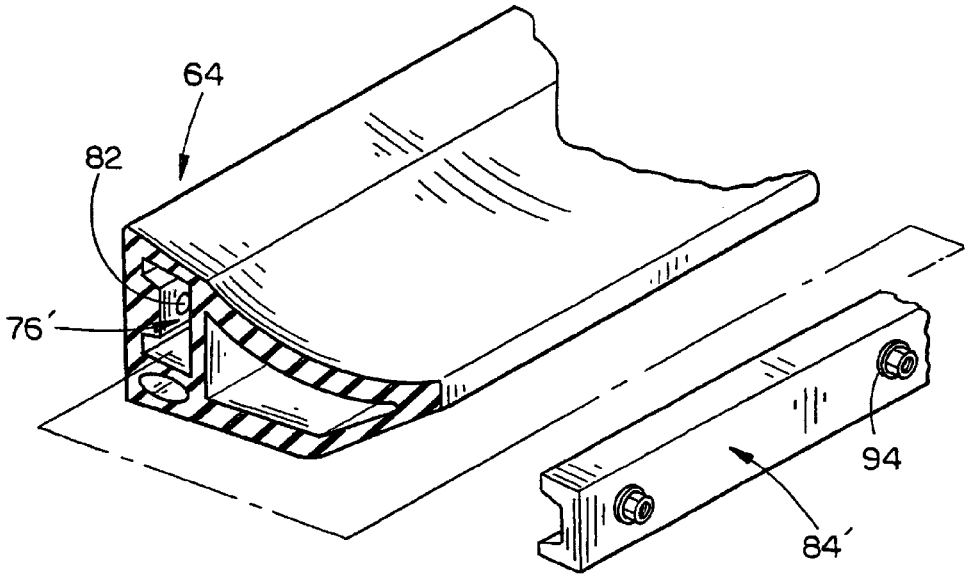
FIG. 4 is a partial exploded perspective view of one of the gauge panel seals of this invention.
Figure 5:
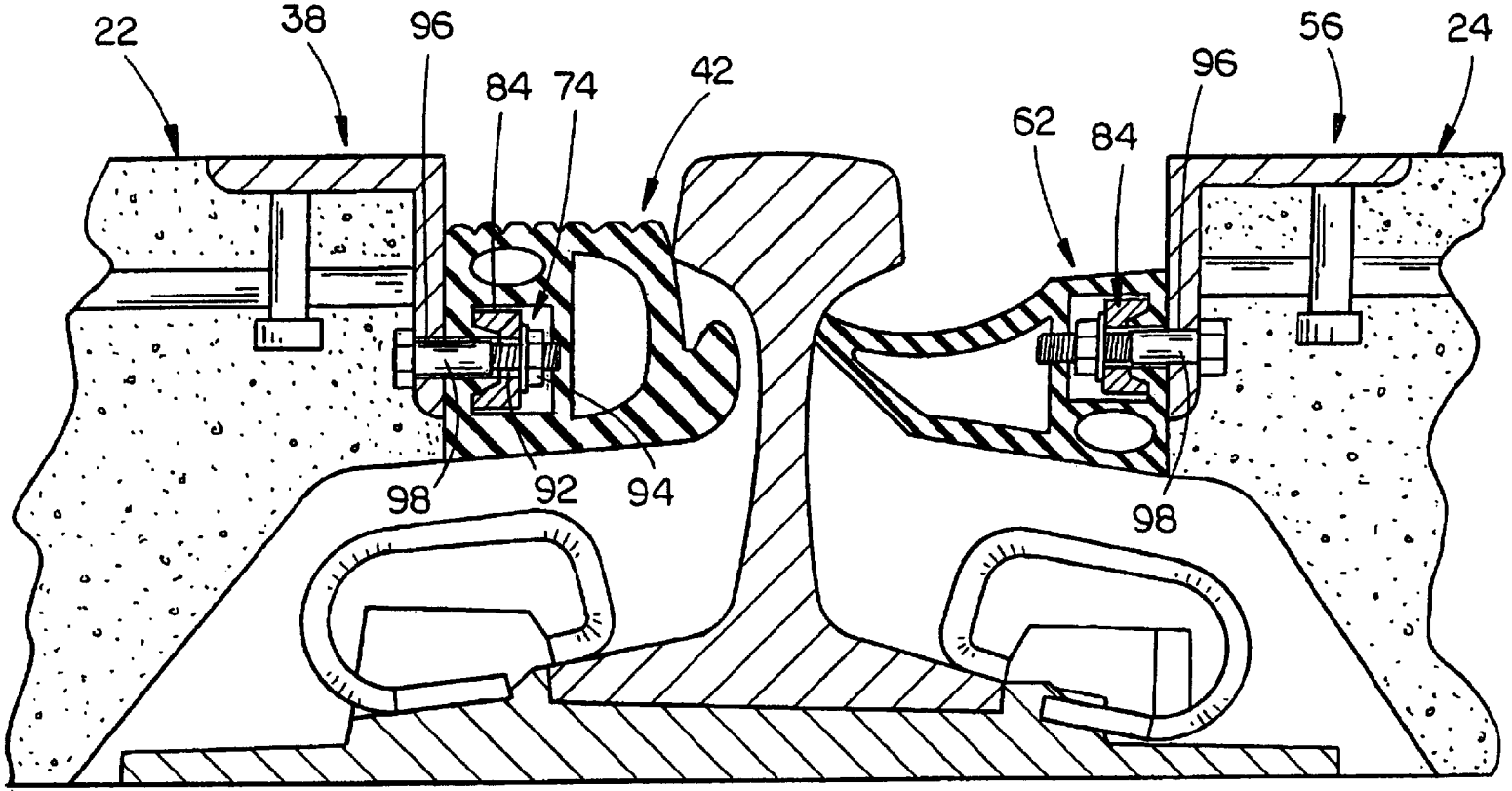
FIG. 5 is a partial vertical sectional view of the concrete railroad grade crossing of this invention.
Figure 6:
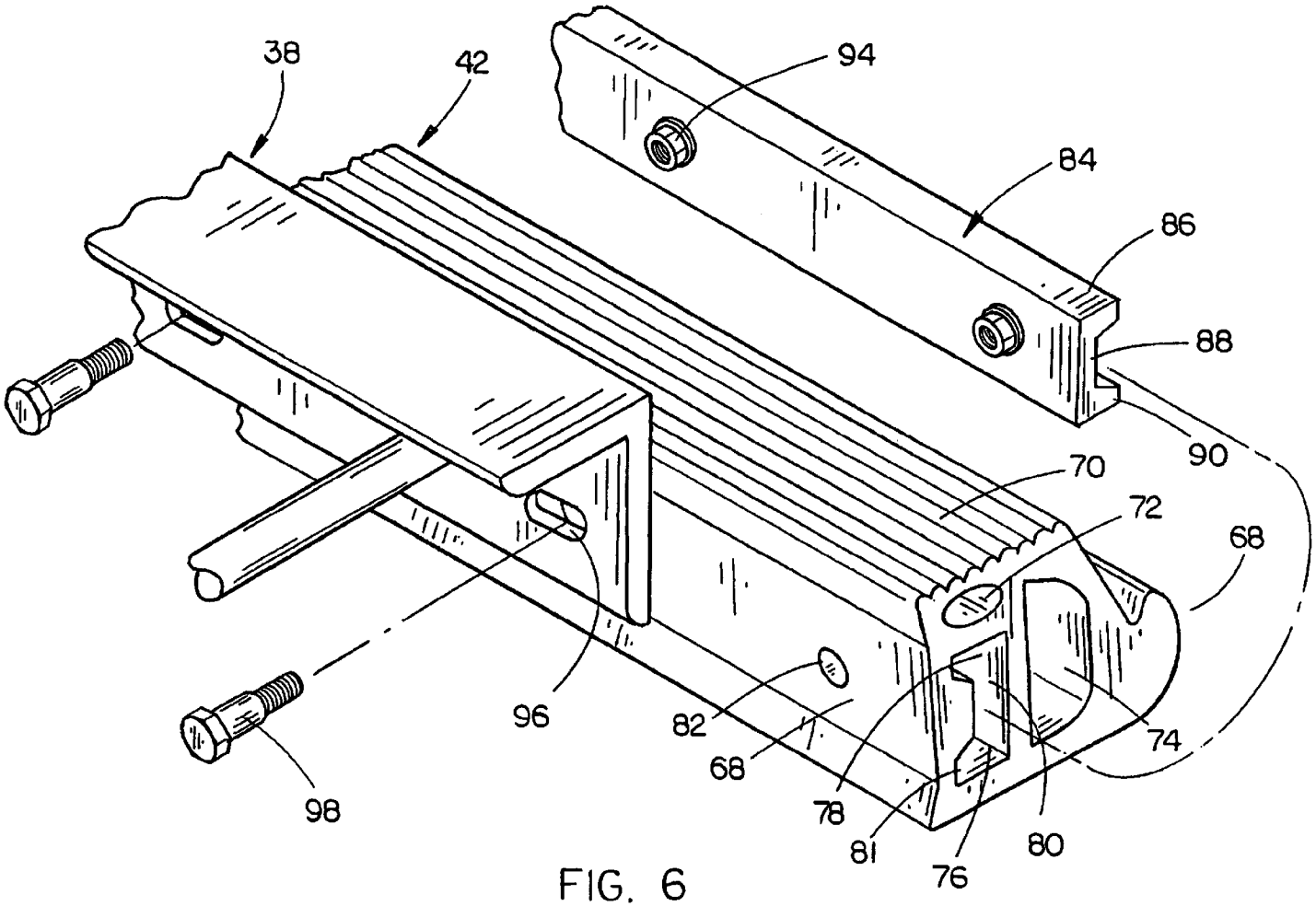
FIG. 6 is a partial exploded perspective view of one of the field seals of this invention.

As seen in FIGS. 3 and 6, field seal 42 is preferably comprised of an elastomeric material generally having an outer end 66 and an inner end 68. The upper end 70 of seal 42 is preferably ribbed, as illustrated in FIG. 6, with upper end 70 being preferably positioned below the top surface of the panel 22 and below the upper end of the associated rail (FIG. 2).

Elongated voids 72 and 74 are formed in the seal 42 to reduce the amount of material required to fabricate the seal. Additional voids may be utilized if so desired. Seal 42 is provided with an elongated channel-shaped cavity 76 formed therein which extends between the ends of the seal. Although other configurations of the cavity 76 may be used, it is preferred that the cavity 76 be channel-shaped in cross-section. For purposes of description, cavity 76 will be described as including an upper cavity portion 78, intermediate cavity portion 80, and lower cavity portion 81. A plurality of horizontally spaced-apart openings 82 extend inwardly from the inner end 68 of seal 42 into the cavity 76. One or more channel members 84 are positioned in cavity 76 as seen in the drawings. For purposes of description, each of the metal channel members 84 will be described as having an upper flange 86, web 88 and lower flange 90. The web 88 is provided with a plurality of horizontally spaced-apart openings 92 formed therein. Flange nuts 94 are welded to web 88 as seen in the drawings at each of the openings 92. Edge protector 38 has a plurality of horizontally spaced-apart slots 96 formed therein. Bolts 98 extend outwardly through slots 96 in edge protector 38, through openings 82, and through openings 92 in channel member 84 for threadable connection to the nuts 94 to secure the seal 42 to the panel 22.

The gauge seals 62 and 64 have elongated channel-shaped cavities 76' formed therein which are identical to the cavities 76 of seal 42 and which receive channel members identical to channel members 84. The edge protectors 56 and 58 have slotted openings 96' formed therein which are identical to slots 96.

The gauge seals 64 are secured to the opposite sides of the gauge panel 24 in a manner identical to that just described. Bolts 98' extend through slots 96' in the vertical leg portion of edge protectors 56 and 58 through openings 82' in seals 62 and 64, through openings 92' in channel members 84' for threadable connection to the nuts 94' which are welded to the channel members 84'.

The bolts 98 and 98' are positioned in the edge protectors during the assembly of the panels prior to concrete being placed into the form. The seals are also attached to the bolts 98 and 98' before concrete is placed into the form. The slots 96 and 96' permit the bolts 98 and 98' to be brought into alignment with the openings 92 and 92'. The bolts are threadably received by the nuts 94 and 94' to securely fasten the seals to the panels. The channel-shaped cavities in the seals help to maintain the channel members 84 and 84' in the seals in the proper position while the seals are being attached to the panels so that the openings 92 will be in alignment with the openings 82.

The invention herein ensures that the seals will be securely attached to the panels and will not become detached therefrom during or after installation. The invention herein also provides a method of attaching the seals to the panels which facilitates rapid assembly of the structure.

Thus it can be seen that the invention accomplishes at least all of its stated objectives.

I claim:

1. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having opposite sides and opposite ends;

said gauge panel having elongated gauge seals on each side thereof which are positioned adjacent the rails;

each of said gauge seals having inner and outer sides and opposite ends;

each of said gauge seals having an elongated cavity formed therein inwardly of the inner side thereof which extends between the ends thereof;

said gauge panel having metal angle members case in said upper opposite sides;

each of said metal angle members including a vertical leg portion;

each of said vertical leg portions of said metal angle members having a plurality of horizontally spaced-apart bolt members secured thereto and extending therefrom through the inner side of the respective seal and into said cavity thereof;

at least one elongated metal retainer positioned in each of said cavities;

each of said retainers having inner and outer sides;

each of said retainers having a plurality of horizontally spaced-apart openings formed therein;

each of said retainers having a plurality of internally threaded nuts welded thereto at each of said openings and in alignment therewith;

said bolt members being threadably secured to said nuts.

2. The railroad grade crossing of claim 1 wherein each of said cavities is generally channel-shaped.

3. The railroad grade crossing of claim 2 wherein said retainers are generally channel-shaped in section.

4. The railroad grade crossing of claim 2 wherein each of said cavities comprises an upper cavity portion having inner and outer ends, an intermediate cavity portion extending downwardly from said outer end of said upper cavity portion, and a lower cavity portion, having inner and outer ends, extending from the lower end of said intermediate cavity portion towards said inner side of the respective seal.

5. The railroad grade crossing of claim 4 wherein said retainers are generally channel-shaped in section.

6. The railroad grade crossing of claim 5 wherein each of said retainers includes an upper flange which is received by said upper cavity portion, a web which is received by said intermediate cavity portion, and a lower flange which is received by said lower cavity portion.

7. The railroad grade crossing of claim 6 wherein said nuts are secured to said webs of said retainers.

8. The railroad grade crossing of claim 7 wherein said webs have inner and outer sides and wherein said nuts are welded to said inner side of said webs.

9. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having opposite sides and opposite ends;

said gauge panel having elongated gauge seals on each side thereof which are positioned adjacent the rails;

each of said gauge seals having inner and outer sides and opposite ends;

each of said gauge seals having an elongated cavity formed therein inwardly of the inner side thereof which extends between the ends thereof;

said gauge panel having metal angle members case in said upper opposite sides;

each of said metal angle members including vertical leg portions;

each of said vertical leg portions of said metal angle members having a plurality of horizontally spaced-apart bolt members secured thereto and extending therefrom through the inner side of the respective seal and into said cavity thereof;

at least one elongated metal retainer positioned in each of said cavities;

each of said retainers having inner and outer sides;

each of said retainers having a plurality of horizontally spaced-apart openings formed therein;

each of said retainers having a plurality of internally threaded nuts welded thereto at each of said openings and in alignment therewith;

said bolt members being threadably secured to said nuts;

a pair of concrete field panels, one of which extends between each rail and the roadway;

each of said concrete field panels having an inner end, an outer end, a top surface which is substantially coplanar with the roadway, and a bottom surface which is supported upon the ties;

said field panels having elongated field seals at their inner ends thereof which are positioned adjacent the associated rail;

each of said field seals generally having an inner end, an outer end, an upper end, and a lower end;

each of said field seals having an elongated cavity formed therein inwardly of the inner side thereof which extends between the ends thereof;

the upper inner end of said field panels having a metal angle member cast therein;

each of said metal angle members including vertical leg portions;

each of said vertical leg portions of said metal angle members having a plurality of horizontally spaced-apart bolt members secured thereto and extending therefrom through the inner side of the respective seal and into said cavity thereof;

at least one elongated metal retainer positioned in each of said cavities;

each of said retainers having inner and outer sides;

each of said retainers having a plurality of horizontally spaced-apart openings formed therein;

each of said retainers having a plurality of internally threaded nuts welded thereto at each of said openings and in alignment therewith;

said bolt members being threadably secured to said nuts.

10. The railroad grade crossing of claim 9 wherein each of said cavities is generally channel-shaped.

11. The railroad grade crossing of claim 10 wherein said retainers are generally channel-shaped.

12. The railroad grade crossing of claim 10 wherein each of said cavities comprises an upper cavity portion having inner and outer ends, an intermediate cavity portion extending downwardly from said outer end of said upper cavity portion, and a lower cavity portion, having inner and outer ends, extending from the lower end of said intermediate cavity portion towards said inner side of the respective seal.

13. The railroad grade crossing of claim 12 wherein said retainers are generally channel-shaped.

14. The railroad grade crossing of claim 13 wherein each of said retainers includes an upper flange which is received by said upper cavity portion, a web which is received by said intermediate cavity portion, and a lower flange which is received by said lower cavity portion.

15. The railroad grade crossing of claim 14 wherein said nuts are secured to said webs of said retainers.

16. The railroad grade crossing of claim 15 wherein said webs have inner and outer sides and wherein said nuts are welded to said inner side of said webs.

17. A railroad grade crossing for extending a roadway across a pair of parallel, spaced-apart rails which are supported upon spaced-apart ties, comprising:

a pair of concrete field panels, one of which extends between each rail and the roadway;

each of said concrete field panels having an inner end, an outer end, a top surface which is substantially coplanar with the roadway, and a bottom surface which is supported upon the ties;

said field panels having elongated field seals at their inner ends thereof which are positioned adjacent the associated rail;

each of said field seals generally having an inner end, an outer end, an upper end, and a lower end;

each of said field seals having an elongated cavity formed therein inwardly of the inner side thereof which extends between the ends thereof;

the upper inner end of said field panels having a metal angle member cast therein;

each of said metal angle members including vertical leg portions;

each of said vertical leg portions of said metal angle members having a plurality of horizontally spaced-apart bolt members secured thereto and extending therefrom through the inner side of the respective seal and into said cavity thereof;

at least one elongated metal retainer positioned in each of said cavities;

each of said retainers having inner and outer sides;

each of said retainers having a plurality of horizontally spaced-apart openings formed therein;

each of said retainers having a plurality of internally threaded nuts welded thereto at each of said openings and in alignment therewith;

said bolt members being threadably secured to said nuts.

18. The railroad grade crossing of claim 17 wherein each of said cavities is generally channel-shaped.

19. The railroad grade crossing of claim 18 wherein said retainers are generally channel-shaped.

20. The railroad grade crossing of claim 18 wherein each of said cavities comprises an upper cavity portion having inner and outer ends, an intermediate cavity portion extending downwardly from said outer end of said upper cavity portion, and a lower cavity portion, having inner and outer ends, extending from the lower end of said intermediate cavity portion towards said inner side of the respective seal.

21. The railroad grade crossing of claim 20 wherein said retainers are generally channel-shaped.

22. The railroad grade crossing of claim 21 wherein each of said retainers includes an upper flange which is received by said upper cavity portion, a web which is received by said intermediate cavity portion, and a lower flange which is received by said lower cavity portion.

23. The railroad grade crossing of claim 22 wherein said nuts are secured to said webs of said retainers.

24. The railroad grade crossing of claim 23 wherein said webs have inner and outer sides and wherein said nuts are welded to said inner side of said webs.

* * * * *